US007548146B2

(12) United States Patent
Parker et al.

(10) Patent No.: US 7,548,146 B2
(45) Date of Patent: Jun. 16, 2009

(54) POWER RELAY

(75) Inventors: David Parker, Shelby, NC (US); Kurt T. Zarbock, Advance, NC (US)

(73) Assignee: Tyco Electronics Corporation, Middletown, PA (US)

( * ) Notice: Subject to any disclaimer, the term of this patent is extended or adjusted under 35 U.S.C. 154(b) by 75 days.

(21) Appl. No.: 11/616,584

(22) Filed: Dec. 27, 2006

(65) Prior Publication Data

US 2008/0157905 A1 Jul. 3, 2008

(51) Int. Cl.
*H01H 67/02* (2006.01)

(52) U.S. Cl. ..... 335/131

(58) Field of Classification Search ..... 335/131, 335/124

See application file for complete search history.

(56) References Cited

U.S. PATENT DOCUMENTS

| | | | | | |
|---|---|---|---|---|---|
| RE20,094 | E | * | 9/1936 | Wilms et al. | 335/131 |
| 2,569,776 | A | * | 10/1951 | Persons | 218/146 |
| 2,666,113 | A | * | 1/1954 | Kuhnke | 335/131 |
| 2,725,488 | A | * | 11/1955 | Hueffed et al. | 307/48 |
| 5,146,196 | A | * | 9/1992 | Frank | 335/271 |
| 5,572,176 | A | * | 11/1996 | Heinzl et al. | 335/129 |
| 5,903,070 | A | * | 5/1999 | Gobel | 310/17 |
| 5,917,394 | A | * | 6/1999 | Fuchs | 335/229 |
| 5,973,581 | A | * | 10/1999 | Jacquin et al. | 335/131 |
| 6,225,880 | B1 | | 5/2001 | Kern | |
| 6,300,851 | B1 | | 10/2001 | Baur et al. | |
| 6,600,640 | B1 | | 7/2003 | Buscher et al. | |
| 6,611,184 | B2 | | 8/2003 | Hoffmann | |
| 6,715,732 | B2 | * | 4/2004 | Kumar | 251/129.16 |
| 6,765,464 | B2 | | 7/2004 | Pietsch et al. | |
| 6,771,153 | B2 | | 8/2004 | Mochizuki | |
| 6,794,966 | B2 | | 9/2004 | Thrush et al. | |
| 6,798,322 | B2 | | 9/2004 | Copper et al. | |
| 7,094,113 | B1 | | 8/2006 | Hasenour et al. | |

* cited by examiner

*Primary Examiner*—Lincoln Donovan
*Assistant Examiner*—Alexander Talpalatskiy

(57) ABSTRACT

A first aspect of the invention includes a power relay assembly having a motor assembly and actuator assembly disposed in a housing. The actuator assembly includes at least one bridge assembly having one or more contacts arranged to provide selective electrical connections. The actuator assembly is attached to an armature of the motor assembly. The armature is arranged and disposed to drive the actuator assembly. The motor assembly includes an electromagnetic coil assembly disposed around at least a portion of the armature. A magnetic pole piece is configured adjacent to an end of the coil assembly. The pole piece includes an armature seat configured to attract and receive the armature when the coil assembly is magnetized. The armature seat has a taper configured to provide a substantially constant attractive force along the stroke length.

9 Claims, 7 Drawing Sheets

POWER RELAY

FIELD OF THE INVENTION

The present invention is directed to electromagnetic relays and to contact systems therefore and, in particular, to electromagnetic relays that reliably operate as normally open and/or normally closed contacts.

BACKGROUND OF THE INVENTION

Electromagnetic relays known in the art typically consist of a multi-turn coil, wound on an iron core, forming an electromagnet. The coil electromagnet is energized by passing current through to magnetize the core. The magnetized coil attracts an armature, which is pivoted to connect or disconnect one or more sets of contacts. When no current is passed through the coil, the coil is no longer magnetized and the armature and contacts are permitted to return to a normal state.

The arrangement of these conventional relays includes a pivoting armature that takes up a significant amount of space and typically must be specifically configured for an arrangement of a relay whose contacts are normally open or a relay having contacts that are normally closed. For example, the configuration of a pivoting armature relay provides a significant force be provided at the end of the armature stroke. In contrast, a closed relay requires a significant force to lift the armature off the contact, for example, to open the circuit, at the beginning of the armature stroke. The pivoting armature arrangement does not provide the force requirements necessary for an electromagnetic motor arrangement that is suitable for both a normally open and a normally closed arrangement.

What is needed is a relay assembly that provides an electromagnetic force that is providing armature force suitable for normally open contacts, normally closed contacts or combinations of contacts that are normally open and normally closed.

SUMMARY OF THE INVENTION

A first aspect of the invention includes a power relay assembly having a motor assembly and actuator assembly disposed in a housing. The actuator assembly includes at least one bridge assembly having one or more contacts arranged to provide selective electrical connection between contact terminals mounted on the housing. The actuator assembly is attached to an armature of the motor assembly. The armature is arranged and disposed to drive the actuator assembly. The motor assembly includes an electromagnetic coil assembly disposed around at least a portion of the armature. The armature is configured to be positionable along a stroke length. A magnetic pole piece is disposed adjacent to an end of the coil assembly. The pole piece includes an armature seat configured to attract and receive the armature when the coil assembly is magnetized. The armature seat has a taper along a surface thereof. The taper is configured to provide a substantially constant attractive force along the stroke length.

Another aspect of the present invention includes a motor assembly for a power relay. The assembly includes an electromagnetic coil assembly disposed around at least a portion of an armature. The armature is configured to be positionable along a stroke length. A magnetic pole piece is disposed adjacent to an end of the coil assembly. The pole piece further comprising an armature seat configured to attract and receive the armature when the coil assembly is magnetized. The armature seat includes a taper along a surface thereof, the taper being configured to provide a substantially constant attractive force along the stroke length.

Still another aspect of the present invention includes an actuator assembly configurable to a normally open relay circuit or a normally closed relay circuit. The assembly includes at least one bridge assembly having one or more contacts arranged to provide selective electrical connection between contact terminals. The actuator assembly is attached to an armature of a motor assembly. The armature is further arranged and disposed to drive the actuator assembly. The actuator assembly is configurable to a normally open relay circuit by attachment of the armature to a first side of actuator assembly and is configurable to a normally closed relay circuit by attachment of the armature to a second side of the actuator assembly.

An advantage of an embodiment of the present invention is that the relay is compact and may occupy a small space.

Another advantage of an embodiment of the present invention is that the relay includes a motor assembly that provides a sufficiently constant force that the motor assembly is suitable for both normally open and normally closed position relay configurations.

Another advantage of an embodiment of the present invention is that the relay may be easily configurable into a normally open or normally closed position.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
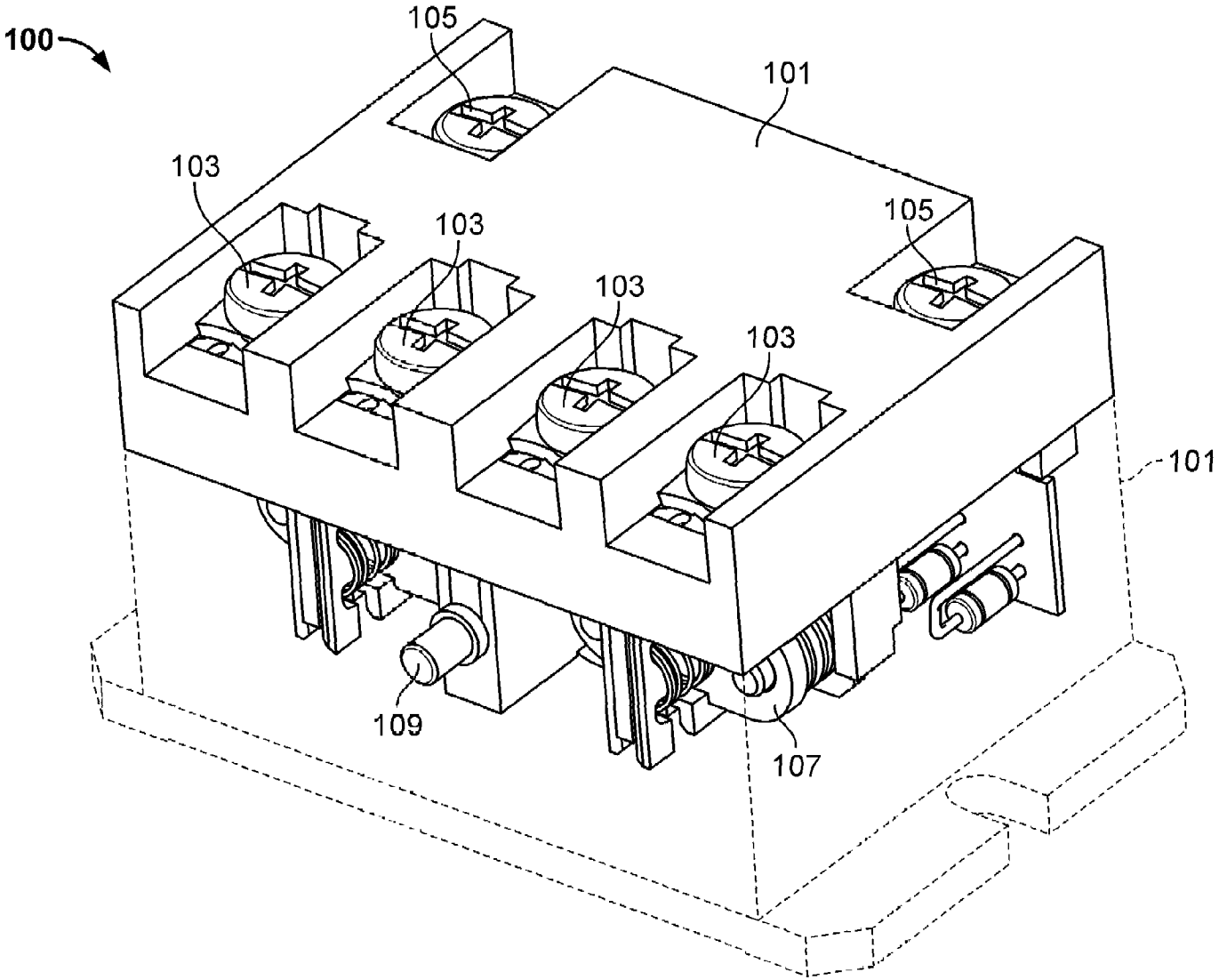
FIG. 1 shows a top perspective view of a relay assembly above according to an embodiment of the present invention.

FIG. 1 shows a relay assembly 100 according to an embodiment of the present invention. The relay assembly 100 includes a housing 101. The housing 101 is configured with relay terminals 103 extending into the interior of housing 101, providing electrical connectivity between relay terminals 103 and components within housing 101. Specifically, relay terminals 103 are in electrical communication with contact terminals 203 (see, e.g. FIG. 2). In addition, coil terminals 105 extend into the interior of the housing 101, providing electrical connectivity between coil terminals 105 and components within housing 101. Specifically, coil terminals 105 are in electrical communication with coil contacts 205 (see, e.g., FIG. 2). Although relay terminals 103 and coil terminals 105 are shown as screw connections, the relay terminals 103 and coil terminals 105 may be any suitable electrical connection that allows connection of electrical wiring or electrical devices. Suitable connections include soldered connections, solderless connections, mechanical contacts, quick disconnects, printed circuit board terminals, screw type terminals or any other conventional electrical connections. Actuator assembly 107 is mounted within housing 101 in a manner that permits a motor assembly 207 (see, e.g., FIG. 2) to reciprocably move the actuator assembly 107 in a direction toward and away from motor assembly 207 (not seen in FIG. 1). The movement of actuator assembly 107 provides physical contact between actuator contacts 209 and contact terminals 203, which provides electrical communication across the corresponding relay terminals 103. Contact terminals 203, actuator contacts 209 and coil contacts 205 are fabricated from any suitable conductive material. Suitable conductive materials include, but are not limited to, copper, copper alloy, brass, bronze, silver plating, gold plating or any other conductive material. In addition, a button 109 may be disposed through housing 101 and is connected to actuator assembly 107. When button 109 is depressed, the actuator assembly 107 is driven in a direction toward motor assembly 207.

Figure 2:
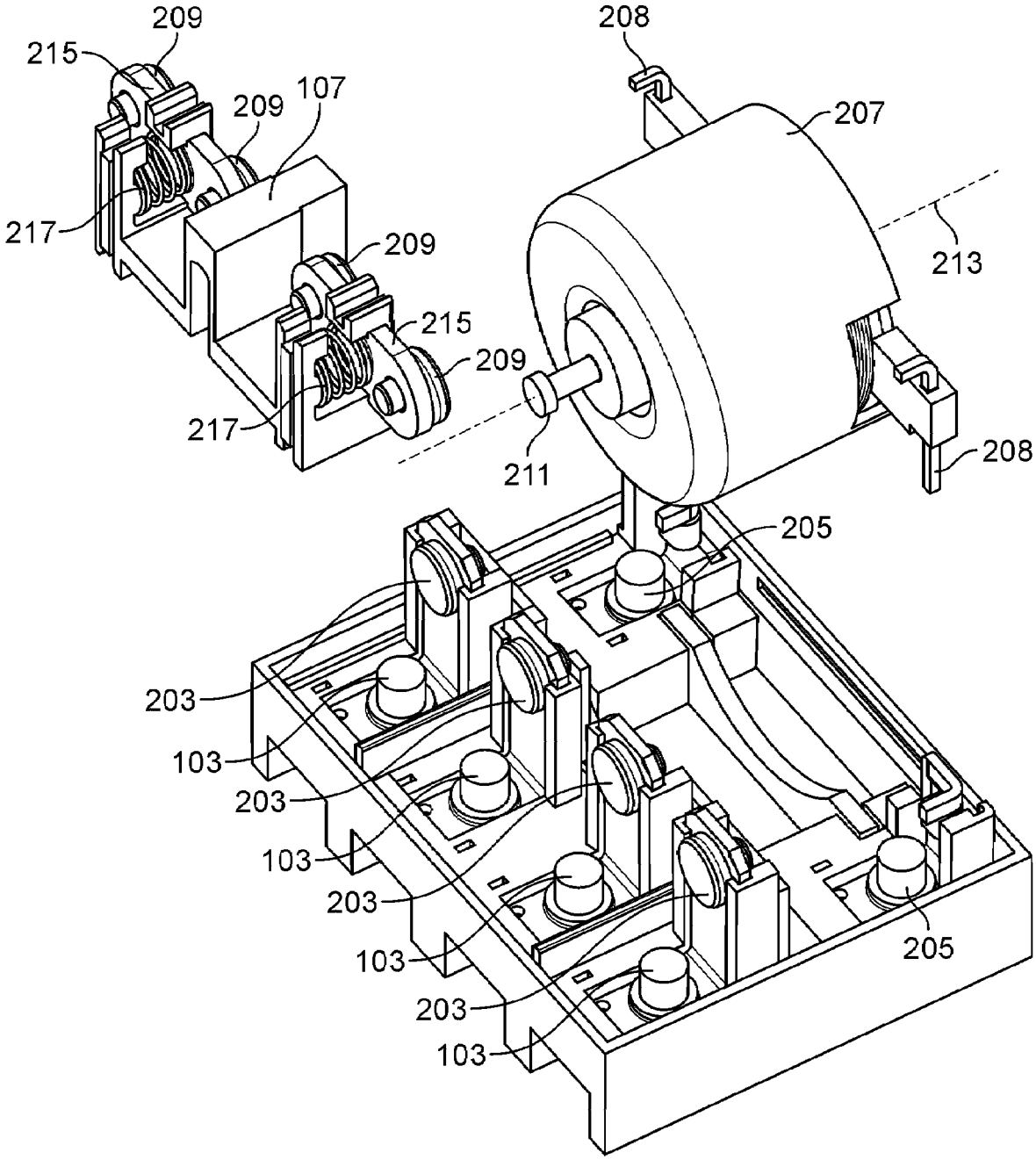
FIG. 2 shows an exploded perspective view of the internal components of a relay assembly from below according to an embodiment of the present invention.

FIG. 2 is an exploded view of the internal components of a relay assembly 100 according to an embodiment of the present invention. Housing 101 is configured to receive motor assembly 207 and actuator assembly 107. Motor assembly 207 includes coil connections 208 that physically contact and electrically communicate with the coil contacts 205. Although, as shown, the motor assembly is configured to receive a direct current (DC), the motor assembly 207 may further include a printed circuit board 301 (see, e.g., FIG. 3) or similar device to allow connection of alternating current (AC) to the motor assembly 207. In addition, motor assembly 207 may be detachably connected to actuator assembly 107 by armature 211. The armature 211 is reciprocably driven along an axis 213 to provide a corresponding reciprocating motion of the attached actuator assembly 107. The actuator assembly 107 is driven to a position between a first position that provides physical contact between actuator contacts 209 and contact terminals 203 and a second position that does not provide contact between actuator contacts 209 and contact terminals 203. The arrangement shown in FIG. 2 is a normally open circuit, wherein the circuit is closed when the motor assembly 207 is energized. However, the invention is not limited to the arrangement shown and may also include actuator assemblies 107 configured for normally closed circuits or combinations of normally open and normally closed circuits. The actuator assembly 107 includes a plurality of bridges 215. Bridges 215 are fabricated from an electrically conductive material and is configured to receive and electrically communicate with actuator contacts 209. Suitable conductive materials include, but are not limited to, copper, copper alloy, bronze, brass, silver plating, gold plating or any other conductive material. The bridge 215 permits electrical connection between corresponding adjacent contact terminals 203 when the actuator assembly 107 is driven to a position that provides physical contact between actuator contacts 209 and contact terminals 203. The actuator assembly 107 further includes a bridge spring 217, which applies a force on the bridge 215, urging the bridge 215 and actuator contacts 209 in a direction toward the contact terminals 203, which assists in maintaining physical contact between actuator contacts 209 and contact terminals 203 and provides for reliable, reproducible electrical communication therebetween.

Housing 101 may also be configured so that one or more relay terminals 103 are reversed such that contact terminal 203 is located such that the actuator assembly 107 is intermediate to the motor assembly 207 and the contact terminal 203. The reverse contact terminal 203 arrangement permits the configuration of a relay assembly 100 that is normally closed (see, e.g., FIGS. 8 and 9). Combinations of this arrangement also permit the actuator assembly 107 to be configured for both normally open and normally closed circuits.

Figure 3:
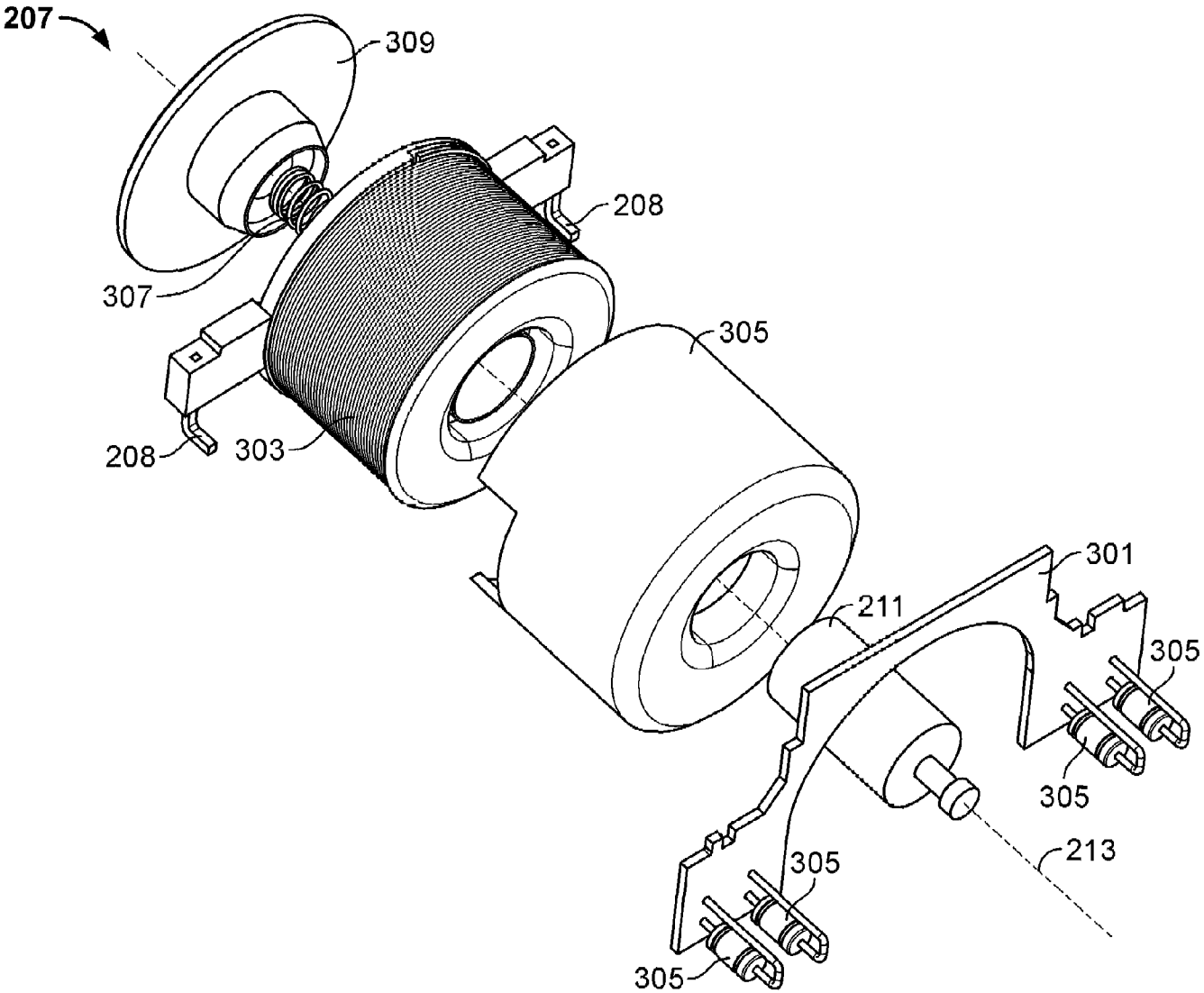
FIG. 3 shows an exploded perspective view of a motor assembly according to an embodiment of the present invention.

FIG. 3 shows an exploded view of motor assembly 207 according to an embodiment of the present invention. Motor assembly 207 includes a coil assembly 303, which is configured as an electromagnetic arrangement preferably including a plurality of wire windings. For example, copper wire may be wound around a bobbin (not shown) to form coil assembly 303. The wire on coil assembly 303 is in electrical communication with coil connections 208 and provide the coil assembly 303 with power to energize the electromagnetic coil assembly 303. A printed circuit board 301 may be in electrical communication with components, such as diodes 304, to provide the desired current (i.e., convert AC current to DC current) to the coil assembly 303. The coil assembly 303 is disposed within coil can 305. Coil can 305 surrounds the coil assembly 303 containing the wire wrappings. Coil assembly 303 and coil can 305 are disposed about axis 213. In addition, armature 211 is disposed along axis 213, wherein at least a portion of the armature 211 is disposed within coil assembly 303. The armature 211 is fabricated from a material that exhibits magnetic properties when exposed to a magnetic field. Suitable materials for armature 211 include iron or iron alloys, preferably soft magnetic ferritic materials, that exhibit electromagnetic properties when exposed to a magnetic field. The motor housing further includes a spring 307, which is disposed within a pole piece 309. Pole piece 309 is fabricated from a material that exhibits magnetic properties. Suitable magnetic material are any magnetic material including, but not limited to soft magnetic ferritic materials. The pole piece 309 is configured to permit the armature 211 to approach and/or contact the pole piece 309. The spring 307 applies a force that urges the armature 211 in a direction away from pole piece 309. However, when current is provided to coil assembly 303, the armature 211 is provided with magnetic properties in response to the current passing through the coil assembly 303 and it becomes attracted to pole piece 309 with a force greater than the force provided by spring 307. The resulting force urges armature 211 to approach and/or contact pole piece 309.

Figure 4:
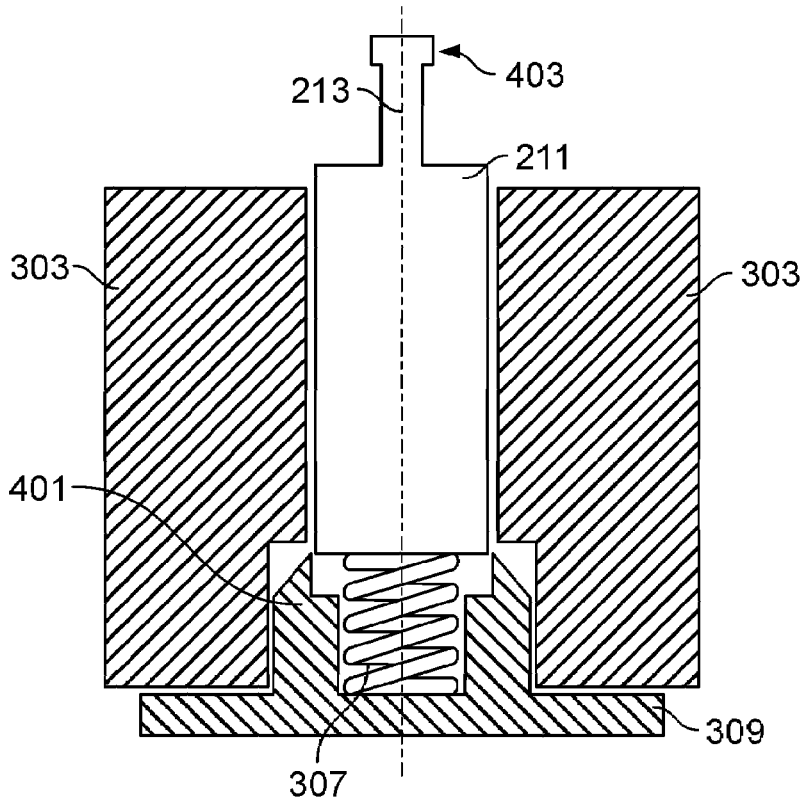
FIGS. 4 and 5 show elevational cross-sectional views of a motor assembly according to an embodiment of the present invention.
Figure 5:
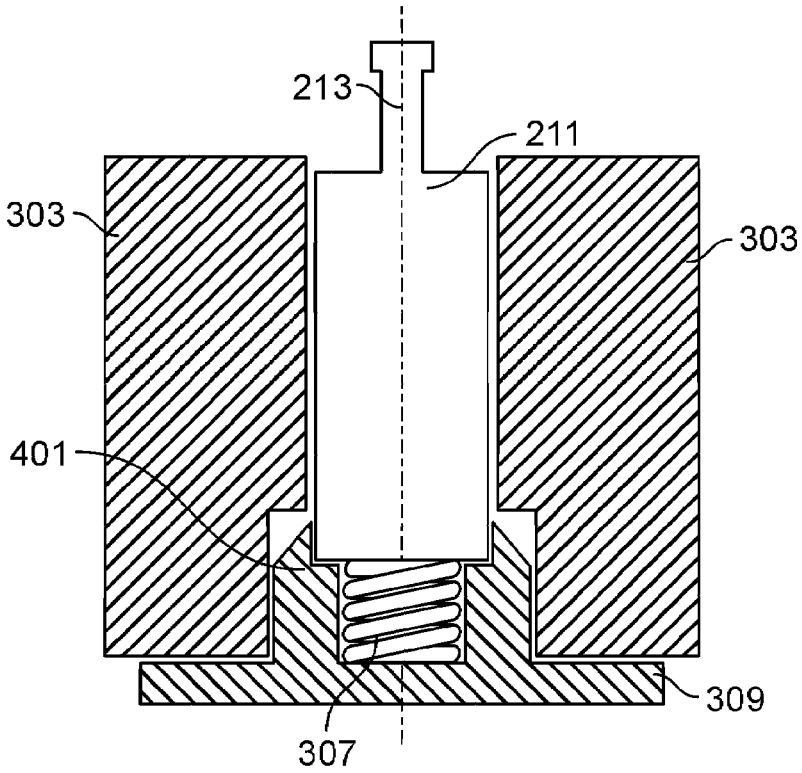

FIG. 4 shows a cross-sectional view of a motor assembly 307 according to an embodiment of the present invention, wherein the coil assembly 303 is not energized. Armature 211 is urged away from pole piece 309 by a force produced by spring 307. As discussed above with respect to FIG. 3, armature 211 is arranged and disposed to reciprocably travel along axis 213. The armature 211 further includes a head 403 which attaches to actuator assembly 107 (not shown in FIG. 4) to provide corresponding reciprocating motion to actuator assembly 107. Pole piece 309 includes an armature seat 401 for receiving armature 211. The arrangement of FIG. 4 illustrates the normal position for motor assembly 207, i.e., prior to actuation of coil assembly 303. However, as shown in FIG. 5, when coil assembly 303 is energized, armature 211 is attracted to pole piece 309 as a result of the electromagnetic properties of armature 211. The armature 211 is attracted to and drawn toward pole piece 309 with sufficient force to overcome the force exerted by spring 307. The attractive force results in the motion of armature 211 approaching or contacting pole piece 309.

Figure 6:
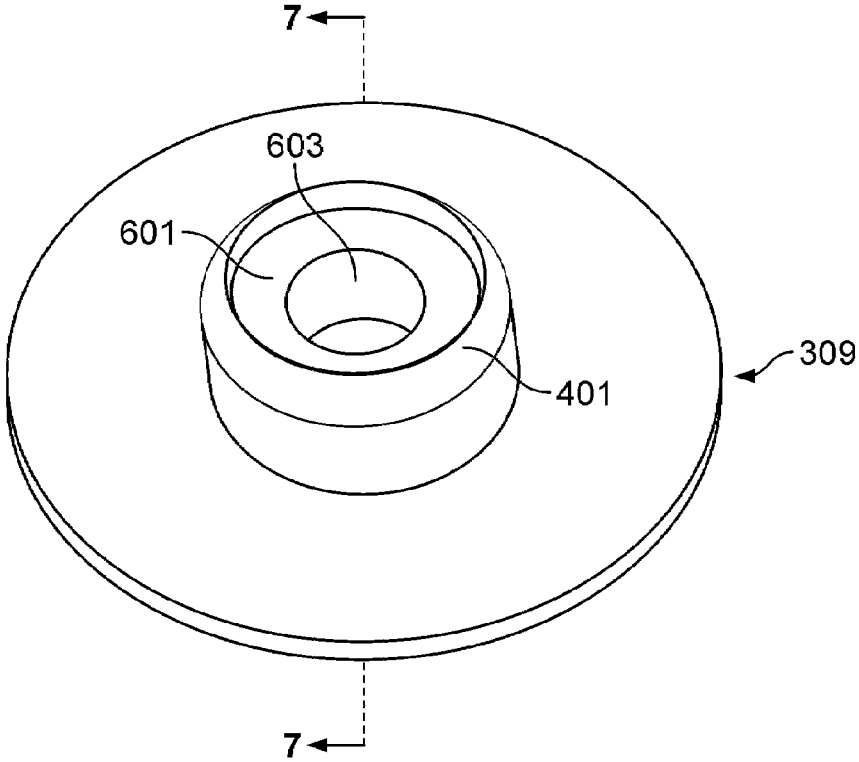
FIG. 6 shows a top perspective view of a pole piece according to an embodiment of the invention.

FIG. 6 shows a perspective view of a pole piece 309 according to the present invention. Pole piece 309 includes an armature seat 401 providing a tapered or sloped surface that extends from a surface of the pole piece 309 circumferentially forming an armature seat ledge 601 providing a space into which the armature 211 may travel and/or contact. The pole piece 309 further includes spring recess 603 for retaining spring 307 (FIG. 5) and permitting compression of spring 307 sufficient to permit armature 211 to approach or contact armature seat ledge 601.

Figure 7:
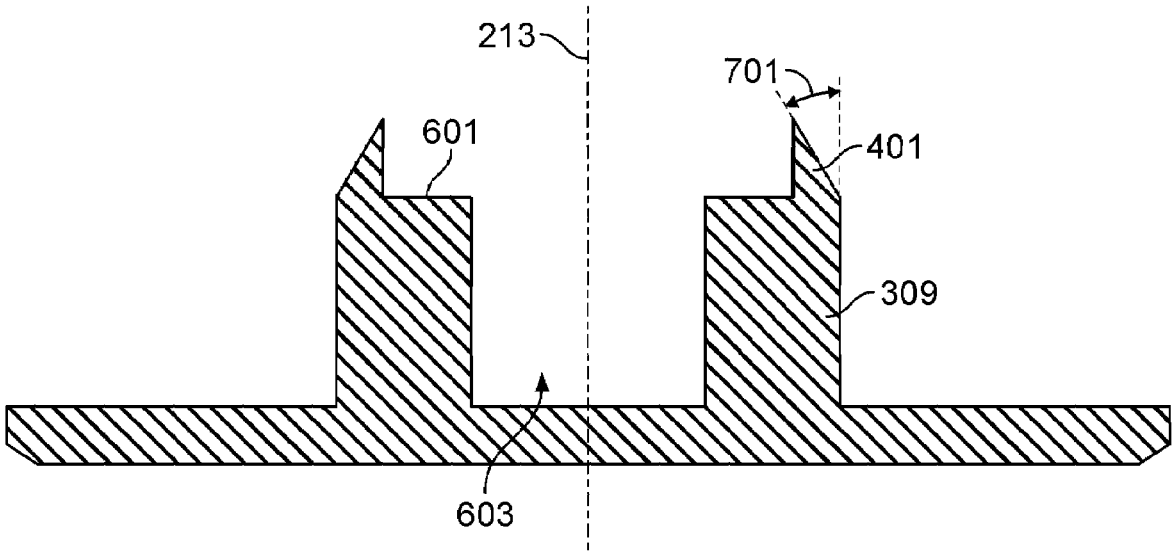
FIG. 7 shows a cross-sectional view of a pole piece taken along line 7-7 of FIG. 6 according to an embodiment of the invention.

FIG. 7 includes an enlarged cross sectional view taken along line 7-7 of FIG. 6. Pole piece 309 is configured with armature seat 401 providing a taper having an angle 701. Armature seat ledge 601 of armature seat 401 provides a surface onto which armature 211 may approach and/or contact. Spring recess 603 provides a space into which spring 307 may be placed and provides sufficient area to allow compression of spring 307 when coil assembly 303 is energized and armature 211 is attracted toward pole piece 309. Angle 701 provides a larger amount of pole piece 309 material near the body of the pole piece 309 and a decreasing amount of pole piece 309 material as the armature seat 401 extends from the body of the pole piece 309. The decreasing amount of material likewise provides a reduced attractive force due to the decreased amount of material at greater distances from the pole piece 309. The angle 701 is configured to provide an attractive force that is substantially constant over the distance that armature 211 travels when the armature 211 is providing the reciprocating motion to the actuator assembly 107.

Figure 8:
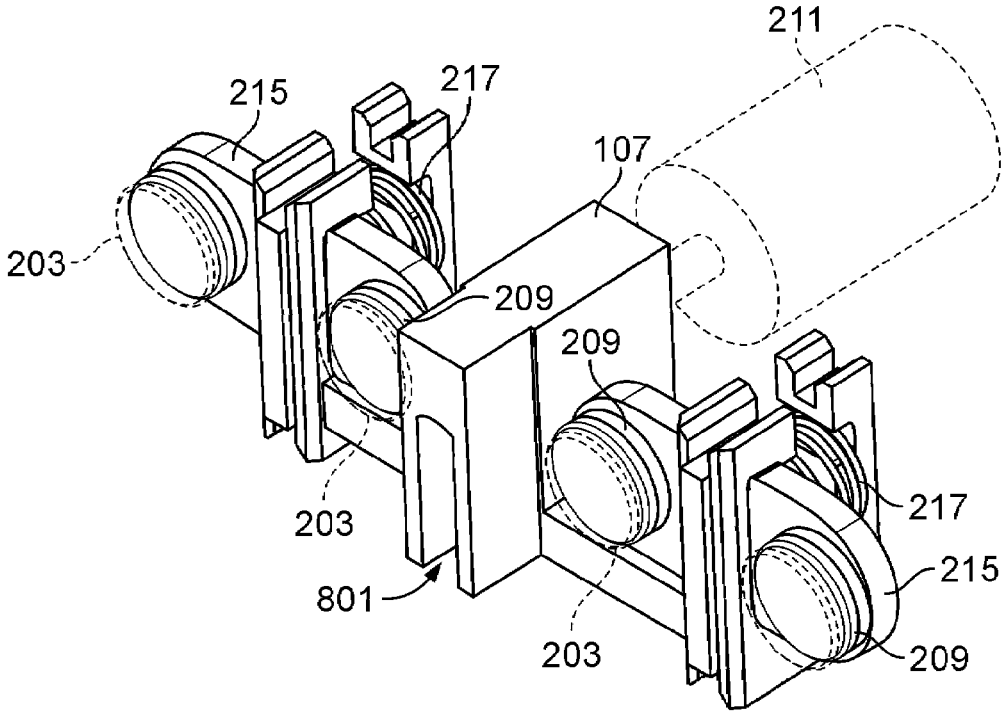
FIGS. 8 and 9 show perspective views of actuator assemblies according to an embodiment of the present invention.

FIG. 8 shows a perspective view of an actuator assembly 107 according to an embodiment of the present invention. Actuator assembly 107 includes slot 801 that detachably engages head 403 of armature 211. The engagement sufficiently attaches the armature 211 to the actuator assembly 107 to permit reciprocable motion of the actuator assembly 107. In this embodiment of the present invention, the actuator contacts 209 are positioned on bridge 215 to provide a normally closed circuit. Specifically, the actuator assembly 107 is positioned intermediate contact terminals 203 and motor assembly 207. The actuator contacts 209 remain in contact with contact terminals 203 until the motor assembly 207 is energized, wherein the actuator contacts 209 are lifted from contact terminals 203 and electrical communication is broken, opening the circuit.

Figure 9:
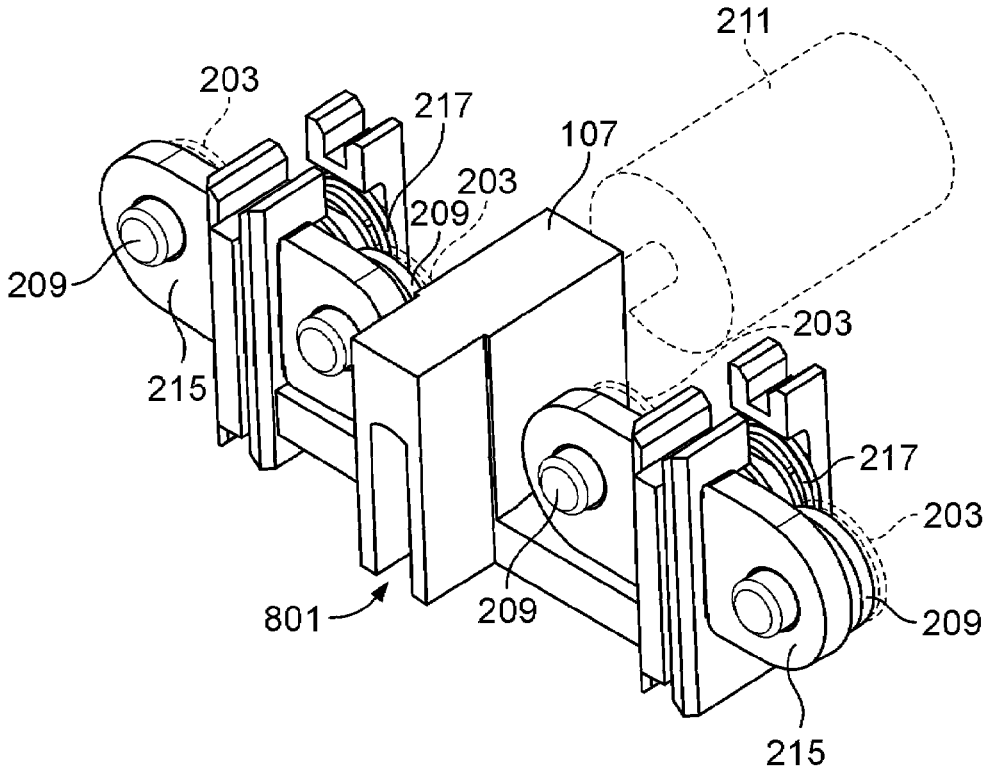

FIG. 9 shows a perspective view of an actuator assembly 107 according to another embodiment of the present invention. In this embodiment of the present invention, the actuator contacts 209 are positioned on bridge 215 to provide a normally closed circuit. Specifically, the actuator assembly 107 is positioned intermediate to contact terminals 203 and motor assembly 207. The actuator contacts 209 remain in contact with contact terminals 203 until the actuator assembly 107 is energized, wherein the actuator contacts 209 are lifted from contact terminals 203 and electrical communication is broken, opening the circuit. Although FIGS. 8 and 9 describe actuator assemblies 107 configured to provide selective electrical communication between two sets of two corresponding contact terminals 203, the actuator assembly 107 may be configured with one bridge 215 or more than two bridges 215 to provide selective connectivity between one set of corresponding contact terminals 203 or more than two sets of corresponding contact terminals 203.

Figure 10:
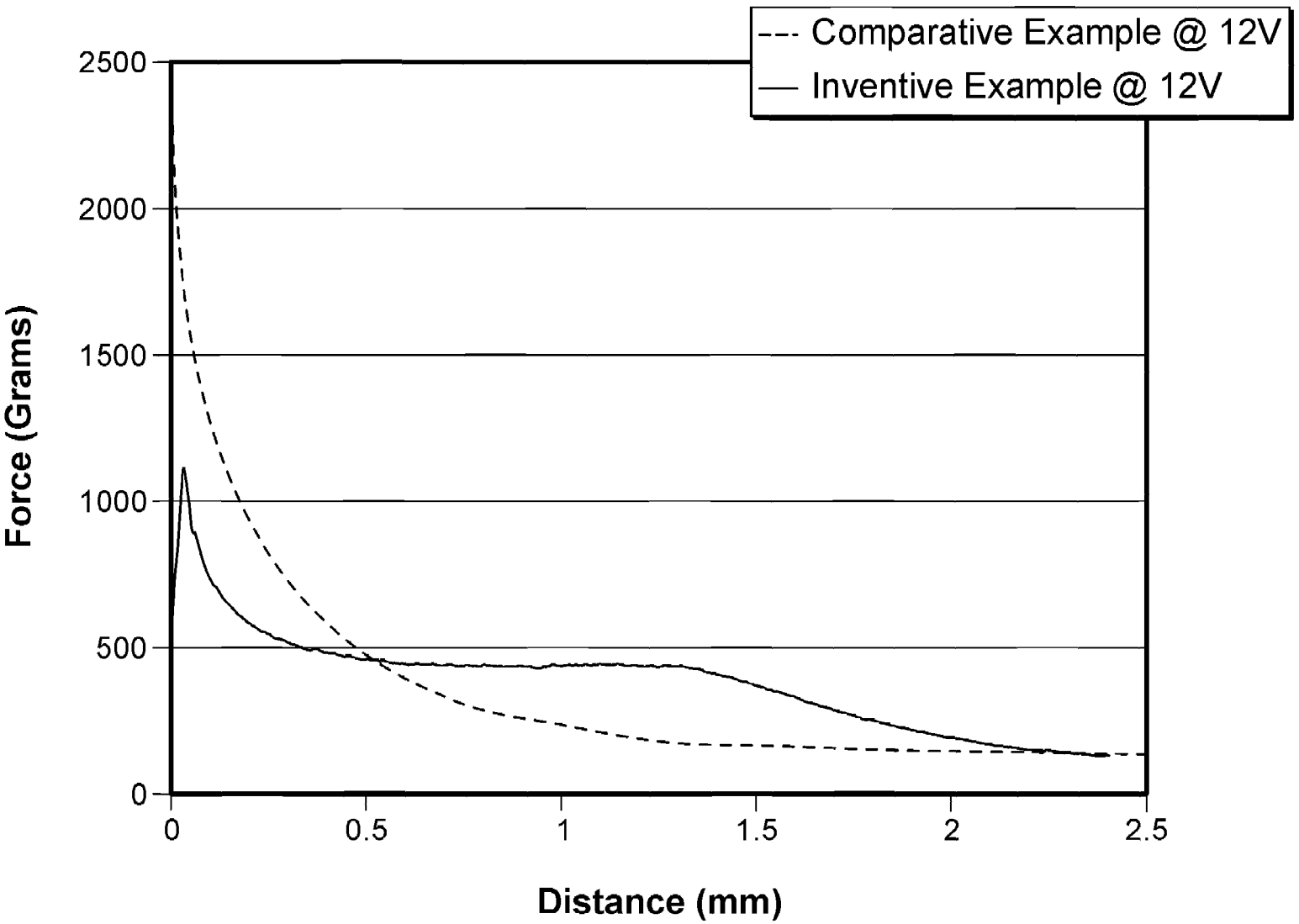
FIG. 10 is a graph showing magnetic force in grams over a solenoid stroke distance.

In an example of the present invention, pole piece 309 including an angle 701 of 30° to provide an attractive force that is substantially constant over the distance that armature 211 travels when the armature 211 is providing the reciprocating motion to the actuator assembly 107. FIG. 10 is a graph showing magnetic force in grams over a solenoid stroke distance for an embodiment of the invention provided with a motor assembly 207 according to an embodiment of the present invention energized with 12 volts. In addition, FIG. 10 shows a comparative example of an electromagnetic solenoid assembly having a cantilever-type assembly known in the art energized with 12 volts.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A power relay assembly comprising:

a motor assembly and actuator assembly disposed in a housing; the actuator assembly comprises:

at least one bridge assembly having one or more contacts arranged to provide selective electrical connection between contact terminals mounted on the housing; and the actuator assembly being attached to an armature of the motor assembly, the armature arranged and disposed to drive the actuator assembly;

the motor assembly comprises:

an electromagnetic coil assembly disposed around at least a portion of the armature, the armature is configured to be positionable along a stroke length;

a magnetic pole piece disposed adjacent to an end of the coil assembly, the pole piece further comprising an armature seat configured to attract and receive the armature when the coil assembly is magnetized; and the armature seat having an armature ledge with a wall extending therefrom, the armature ledge and wall forming a recess into which the armature may travel, a tapered surface extending from the wall to a surface of the magnetic pole piece, the tapered surface extending circumferentially about the armature seat ledge such that tapered surface is positioned outside of the recess into which the armature may travel, the tapered surface being configured to provide a substantially constant attractive force along the stroke length.

2. The relay of claim 1, further comprising a spring being disposed between the pole piece and the armature, applying a force to the armature, urging the armature in a direction away from the pole piece.

3. The relay of claim 2, wherein the pole piece includes a recess for receiving the spring.

4. The relay of claim 1, wherein the bridge assembly is configured to provide selective electrical contact between a plurality of sets of terminal contacts.

5. The relay of claim 4, wherein the bridge assembly and terminal contacts are arranged to provide a normally open circuit between terminal contacts in a set of terminal contacts.

6. The relay of claim 4, wherein the bridge assembly and terminal contacts are arranged to provide a normally closed circuit between terminal contacts in a set of terminal contacts.

7. The relay of claim 4, wherein the bridge assembly and terminal contacts are arranged to provide a combination of normally closed circuits between terminal contacts and normally open circuits between terminal contacts in corresponding sets of terminal contacts.

8. The relay of claim 1, wherein the taper has an angle to a direction of travel of the armature of about 30°.

9. The relay of claim 1, wherein the armature seat includes a ledge for receiving the armature.

* * * * *